US005248238A

United States Patent [19]

Ishida et al.

[11] Patent Number: 5,248,238

[45] Date of Patent: Sep. 28, 1993

[54] VORTEX PUMP

[75] Inventors: Shinji Ishida; Kazunori Matsui, both of Chiryu, Japan

[73] Assignee: Nippondenso Co., Ltd., Kariya, Japan

[21] Appl. No.: 868,562

[22] Filed: Apr. 15, 1992

[30] Foreign Application Priority Data

Apr. 15, 1991 [JP] Japan ..... 3-82553

[51] Int. Cl.[5] ..... F04D 29/70

[52] U.S. Cl. ..... 415/55.1; 415/170.1

[58] Field of Search ..... 415/55.1, 55.2, 55.3, 415/55.4, 55.5, 170.1

[56] References Cited

U.S. PATENT DOCUMENTS

| | | | |
|---|---|---|---|
| 4,194,798 | 3/1980 | Schonwald et al. | 415/55.1 |
| 4,204,802 | 5/1980 | Schonwald et al. | 415/55.1 |
| 4,806,073 | 2/1989 | Schonwald | 415/55.1 |
| 4,907,945 | 3/1990 | Schonwald | 415/55.1 |
| 4,943,208 | 7/1990 | Schonwald | 415/55.1 |
| 4,992,022 | 2/1991 | Aust et al. | 415/55.1 |

FOREIGN PATENT DOCUMENTS

| | | | |
|---|---|---|---|
| 29768 | 12/1920 | Japan | 415/55.1 |
| 55-41531 | 3/1980 | Japan . | |
| 57-184295 | 11/1982 | Japan . | |
| 207890 | 9/1986 | Japan | 415/55.2 |
| 724800 | 3/1980 | U.S.S.R. | 415/55.1 |

*Primary Examiner*—John T. Kwon

*Attorney, Agent, or Firm*—Cushman, Darby & Cushman

[57] ABSTRACT

A housing 14 forms, together with a cover 34, an annular vortex chamber 42. An impeller 22 is provided with a disk portion 24 which is connected to a drive shaft 12 so that the impeller 22 rotates integrally with the shaft 12. The impeller 22 has an annular support portion 26 and rows of angularly-spaced blade portions 28 and 30 arranged along the circumference of the impeller. The blade portions 28 and 30 are located in the vortex chamber 42. A seal portion is created between the impeller 22, the housing 14 and the cover 34, which seal portion is constructed by inner axial slits 72A and 72B formed between axially-spaced surfaces transverse to the axis of the shaft 12, radial slits 74A and 74B formed between radially spaced-apart cylindrical surfaces, and outer axial slits 76A and 76B formed between axially spaced-apart surfaces transverse to the axis of the shaft 12. The thickness of the radial slits 74A and 74B is smaller than a half of the thickness of at least one of the inner or outer axial slits, and the length of the radial slits 74A and 74B is between 2 mm and 5 mm.

5 Claims, 6 Drawing Sheets

VORTEX PUMP

BACKGROUND OF THE INVENTION

1. Field of the Invention

The present invention relates to a vortex pump used, for example, as an air pump in an internal combustion engine.

2. Description of the Related Art

Japanese Unexamined Utility Model Publication No. 55-41531 discloses a vortex pump as an air pump utilized for an internal combustion engine for reducing an amount of toxic emissions in an exhaust gas therefrom.

This kind of vortex pump is provided with a housing, and a cover connected to the housing such that an annular vortex chamber is formed between the housing and the casing. An impeller is constructed by a disk on a drive shaft connected to a rotating motor, an annular blade support portion integral with the outer end of disk member, and two rows of angular blades along the entire circumference of the support portion, which blades are integral with the support portion. The blades are located in the vortex chamber and cause a forced flow of fluid to be introduced into the vortex chamber, which is then forced out therefrom. The housing and the casing have a pair of opposite annular projections extending axially toward each other such that an annular space is formed between the opposed projections. The disk portion of the impeller is located such that it passes radially through the annular space, whereby the disk portion is connected to the blade support portion at a location radially outside of the annular projected portions, to thus create a seal constructed by a pair of axial slits formed between the annular projection of the housing and the disk portion, and the annular projection of the cover and the disk portion, a pair of axial slits formed between the support portion and the housing, and the support portion and the cover, and a pair of radial slits formed between the support portion and the housing, and the support portion and the cover. These inner and outer pairs of the axial slits are connected to each other via the respective radial slits.

In such a construction of the seal, an inwardly directed flow of leak fluid from the vortex chamber occurs via the outer axial slits, the radial slits, and then the inner axial slits. Namely, a steep change through an angle of 90 degrees in the direction of the flow of the leak flow occurs not only at the location at which the outer pair of the axial slits are connected to the radial slits, but also at the location at which the radial slits are connected to the inner pair of the axial slits. Such a steep change in the direction of the flow of the leak fluid allows the leak resistance value of the fluid to be increased, whereby an effective seal effect can be obtained without increasing the length of the seal.

In this type of vortex pump, to obtain an effective sealing effect, the thicknesses of these outer axial slits, intermediate radial slits, and inner axial slits should be kept as small as possible, but in this connection, upon assembling, it is inevitable that the disk portion of the impeller be connected to the drive shaft under a condition such that the disk member is more or less inclined with respect to the shaft. Such an inclined assembly of the disk portion of the impeller to the drive shaft causes the impeller to come into contact with the housing or the cover when the thicknesses of the slits are small. Therefore, the value of the thicknesses of the slits has been made a relatively large value, so that no contact of the parts via these slits occurs even when the disk member is connected to the drive shaft under an inclined condition, and thus the sealing ability is inevitably worsened.

In such a kind of vortex pump, to obtain a desired effective sealing ability, it is possible to elongate the lengths of these slits while keeping the thicknesses of the slits as small as possible, such that any contact between the impeller and the housing or cover is prevented even when the impeller disk portion is obliquely connected to the shaft. This solution of an increased length of the slits is disadvantageous in that there will be a corresponding increase in a rotating momentum of the impeller. Furthermore, an increase of the length of the radial slits may cause the axial thickness of the disk portion to be decreased, to thereby lower the mechanical strength of the disk portion when it is subjected to a centrifugal force during a high speed rotation of the impeller.

SUMMARY OF THE INVENTION

An object of the present invention is to provide a vortex pump capable of overcoming the above-mentioned problems with the prior art.

Another object of the present invention is to provide a vortex pump capable of preventing any contact between the housing and the impeller while also preventing any deterioration of the seal effect provided by a seal.

According to the present invention, a vortex pump is provided which comprises:

a casing;

a drive shaft having axially spaced-apart ends, the shaft being rotatable with respect to the casing;

a pair of axially spaced-apart bearing units for supporting the shaft with respect to the casing;

said casing defining therein an annular vortex chamber about an axis of the drive shaft and an annular gap inward of the vortex chamber with respect to the drive shaft;

inlet duct means for introducing a fluid into the vortex chamber;

outlet duct means for removing the fluid from the vortex chamber;

an impeller having a disk portion having axially spaced-apart major surfaces extending transverse to the axis of the shaft, an annular support portion at an outer peripheral end of the disk portion and having an axial width larger than that of the disk portion, and rows of a plurality of circumferentially spaced-apart blades mounted on the annular support portion, and;

means for connecting the disk portion to the drive shaft such that the impeller is rotated integrally with the drive shaft;

the blade portions being arranged such that they act on the fluid in the vortex chamber to thereby generate a forced flow of the fluid from the inlet duct means to the outlet duct means, and;

the disk portion passing radially through the annular gap such that a seal is created between the impeller and the casing by an axially spaced-apart pair of annular first slits formed between axially spaced-apart facing surfaces of the disk portion and the casing, extending transverse to the axis of the shaft; an axially spaced-apart pair of annular second slit formed between radially spaced-apart cylindrical surfaces of the casing and the impeller and located radially outward of the inner slits; and an axially spaced-apart pair of annular third slits formed between axially spaced apart facing surfaces of the casing and the impeller and extending transverse to the axis of the shaft and located radially outward of the second slits;

said second slits having a ,radial thickness smaller than a half of a thickness of at least one of the first and second slits, and a length of the second slits being between 2 mm and 5 mm.

According to the present invention, the seal between the casing and the impeller along the annular gap is constructed by the inner first axially spaced slits, the intermediate second radially spaced slits, and the outer third axially spaced slits, such that an amount of the fluid leaked inward from the vortex chamber is a function of a thickness and length of these slits. A test conducted by the inventors for a vortex pump clarified the following findings. First, as long as a construction whereby the disk portion of the impeller is inserted to the drive shaft is employed, upon an inclination of the plane of the disk portion with respect to the axis of the drive shaft a degree of reduction in the thickness of the second, radial slit is far smaller than the degree of the reduction in the thickness of the first or second axial slits. Accordingly, a far greater reduction of the thicknesses of the radially spaced slits than the reduction of the thicknesses of the radially extending slits does not increase the possibility of a contact by the second radial slits, and as a result, an increased sealing effect can be obtained with the small value of the thickness of the second radial slits.

Second, contrary to a usual knowledge, it was revealed that, in a usual range of the length of the slits formed by the radially spaced surfaces, a linear proportional relationship is obtained between the axial length of the radial slits and increases the sealing effect (increase in the amount of fluid discharged) when the length of the radial slits is up to 2 mm. The longer the value of the length of the radial slits from 2 mm, the smaller the increase in the sealing effect, and a length of the radial slits larger than 3 mm provides no increase in the sealing effect.

In view of the above, the inventors concluded that a desired sealing effect is obtained when the thickness of the radial slit is smaller than a half that of the axial slit, and the length of the radial slit is larger than 2 mm and smaller than 5 mm. Namely, an axial length of the radial slit smaller than 2 mm reduces the sealing effect, and accordingly, reduces the amount of fluid to be discharged. Conversely, a value of the length of the radial slit larger than 5 mm does not increase the sealing effect, but reduces the axial thickness in the disk portion, causing the durability thereof to be lowered. Namely, a length of the radial seal of between 2 mm and 5 mm provides both an increased seal effect and a desired value of the axial thickness of the disc portion of the impeller.

BRIEF DESCRIPTION OF THE ATTACHED DRAWINGS

DESCRIPTION OF THE PREFERRED EMBODIMENTS

Figure 1:
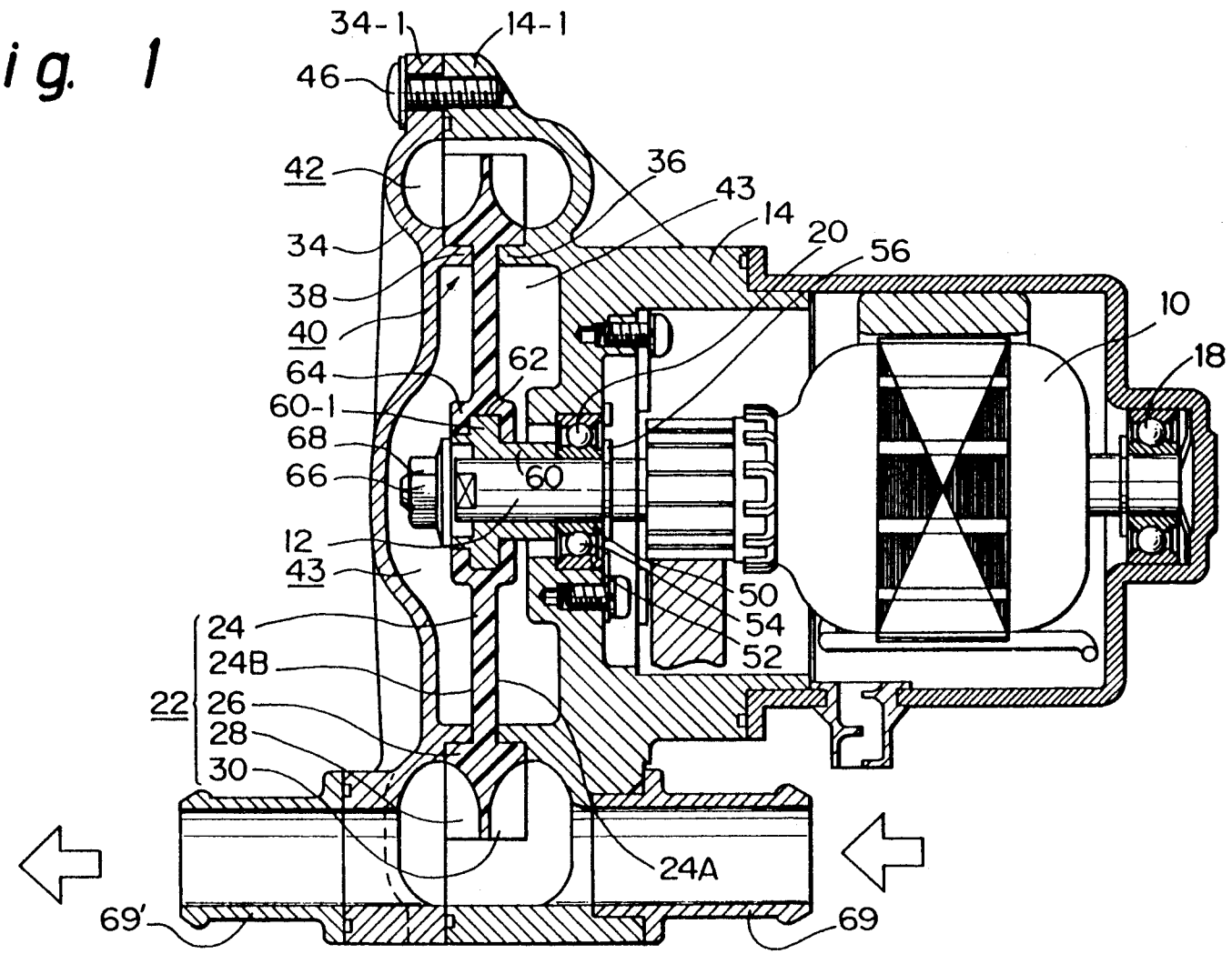
FIG. 1 is a longitudinal cross sectional view of a vortex pump according to the present invention.
Figure 2:
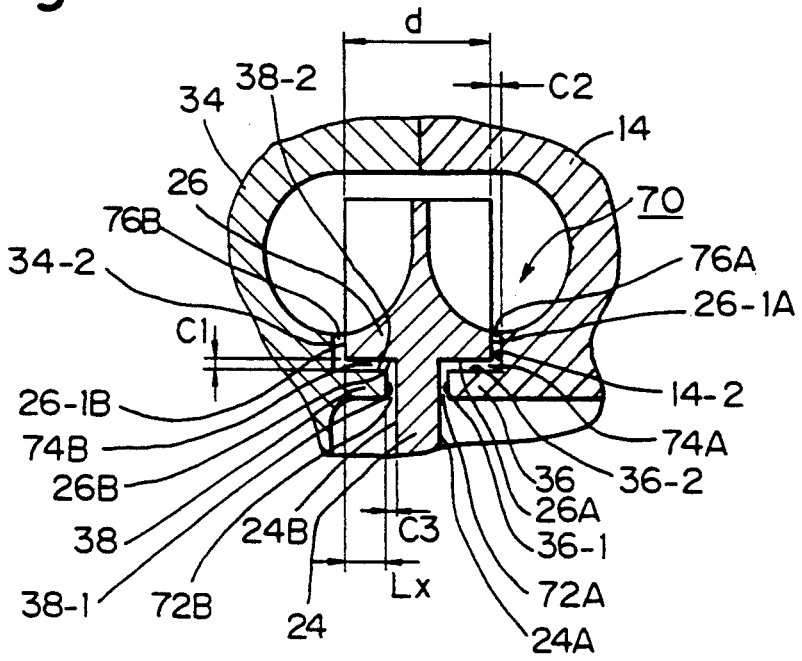
FIG. 2 is an enlarged view of a portion around the vortex chamber in FIG. 1.

FIG. 1 shows a first embodiment of an air pump according to the present invention. The air pump is a vortex pump having an electric motor integrated therewith. Namely, the air pump is provided with an electric motor 10 having a drive shaft 12, a housing 14 formed integrally with the motor 10 and having an outer flange portion 14-1, a pair of axially spaced-apart ball bearing assemblies 18 and 20 for rotatably supporting the drive shaft 12 of the motor 10, and an impeller 22 rotating integrally with the drive shaft 12. The impeller 22, which is one-piece member moulded from a fiber glass-plastic composite material as will be fully described later, is composed of a disk portion 24 having a substantially circular shape and fixedly connected to an end of the drive shaft 12 spaced from the electric motor 10, an annular blade support portion 26, and blades 28 and 30 extending from the support portion 26. The blades 28 are located on one side of the impeller adjacent the cover 34 such that they are equiangularly spaced along the circumference of the impeller. The disk portion 24 defines axially spaced-apart opposite surfaces 24A and 24B extending transversely to the axis of the shaft 12. The blade support portion 26 defines cylindrical inner surfaces 26A and 26B having the same radius of the outer periphery of the sides of the disk portion 24, respectively, and axially opposite surfaces 26-1A and 26-1B extending transverse to the axis of the shaft 12. The housing 14 defines an annular surface 36-1 extending transverse to the axis of the shaft 12 and facing the surface 24A of the portion 26, a cylindrical surface 36-2 extending axially and facing the surface 26A of the support portion 26, and a surface 14-2 extending transverse to the axis of the shaft 12 and facing the surface 26-1A of the support portion 26. Similarly, the cover 34 defines an annular surface 38-1 extending transverse to the axis of the shaft 12 and facing the surface 26B of the portion 26, a cylindrical surface 38-2 extending axially and facing the surface 26A of the support portion 26, and a surface 34-2 extending transverse to the axis of the shaft 12 and facing the surface 26-1B of the support portion 26. The blades 30 are located on the other side of the impeller and adjacent to the housing 14, in such a manner that they are equiangularly spaced along the circumference of the impeller. The disk portion 26 forms a pair of axially spaced-apart surfaces 26-1A and 26-1B as shown in FIG. 2.

The air pump further includes a cover 34 arranged so as to face the housing 14. The housing 14 and the cover 34 have annular projections 36 and 38 extending axially and facing each other, to thus create an annular spacing 40 through which the disk portion 24 is arranged as will be described fully later. The cover 34 has an outer flange portion 34-1 in face-to-face contact with the flange 14-1 of the housing 14, such that a vortex chamber 42 is formed between the housing 14, and the cover 34 outward of the annular projections 36 and 38 and in which the impeller is contained. Bolts 46 connect the cover 34 with the housing 14 to thereby obtain an assembled casing. A disk chamber 43 is formed between the housing 14 and the cover 34, inward of the annular gap.

The ball bearing unit 20 is constructed by an inner race 50 inserted to the shaft 12, an outer race 52 inserted to the housing 14, and balls 54 accommodated between the inner and the outer races 50 and 52. The outer surface of the shaft 12 has an annular groove formed therein, to which a C-ring 56 is inserted such that it comes into contact with the inner race 50 of the bearing, for delimiting the axial position of the bearing unit 20 on the shaft 12. A sleeve or insert member 60 is inserted to the shaft 12 such that it comes into contact with the inner race 50 of the bearing unit 20 at a side thereof remote from the C-ring 56. The insert 60 is provided with an annular projection 60-1 engageable with an annular inner groove 62 formed along the inner periphery of a boss portion 64 of the disk 24. A screwed shaft 66 is axially and integrally extended from a free end of the shaft 12, and a nut 68 is screw-engaged with the screwed end of the shaft 12 such that the nut 68 is engaged an end of the insert member 60, to thereby allow the inner race 50 of the bearing assembly 20 to be fixed between the insert member 60 and the C-ring 56.

One end of an inlet pipe 69 is connected to a fluid source (not shown) and the other end thereof is connected to the housing 14 such that the inlet pipe 69 is opened to the vortex chamber 42 for introducing a fluid therein. One end of an outlet pipe 69' is connected to the vortex chamber 42, for removing the fluid therefrom, and the other end is connected to a receiver, such as an internal combustion engine (not shown), for supplying the high pressure fluid therefrom.

As shown in detail in FIG. 2 the disk portion 24 passes radially through the annular gap between the annular projection 36 of the housing 14 and the annular projection 38 of the cover 34, whereby a seal portion 70 is created between the impeller 22, the housing 14 and the cover 34. The seal portion 70 is constructed by a pair of annular slits 72A and 72B formed between the axially spaced and radially extending surfaces 24A and 36-1, and 24B and 38-1, respectively, a pair of annular slits 74A and 74B between the radially spaced and axially extended annular surfaces 36-2 and 26A, and between the radially spaced and axially extended annular surfaces 38-2 and 26B, respectively, and a pair of annular slits 76A and 76B between the axially spaced and radially extended surfaces 26-1A and 14-2, and between the axially spaced and radially extended surfaces 26-1B and 34-2, respectively. The slits 72A and 72B, and 76A and 76B, created between axially spaced-apart surfaces transverse to the axis of the shaft 12, are referred to hereafter as axial slits, and the slits 74A and 74B, created between radially spaced-apart cylindrical surfaces, are referred to as radial slits. Note, the thickness $C_1$ of the radial slits 74A and 74B is smaller than a half of the thickness $C_3$ of the inner axial slits 72A and 72B, and the thickness $C_2$ of the outer axial slits 76A and 76B. Furthermore, it should be noted that the length of the radial slit 74A or 74B is 3.9 mm.

Figure 3:
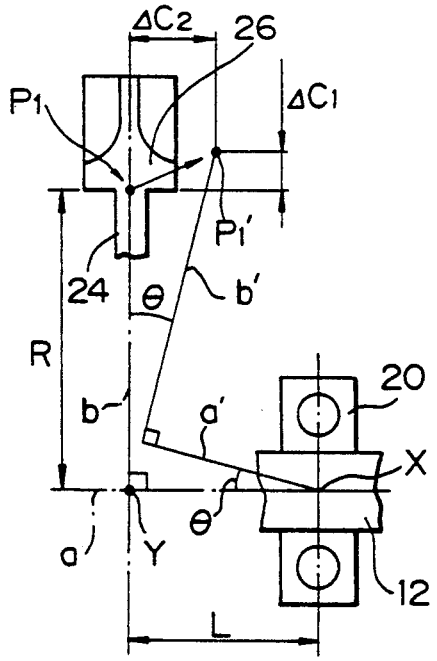
FIG. 3 is a schematic view of changes in the thickness of the slits in accordance with an inclination of the axis of the shaft.

In FIG. 3, an inclination of the axis of the drive shaft 12 from a desired axis causes a varying of the value of the thicknesses $C_1$, $C_2$ and $C_3$ of the first slits 74A and 74B, the second slits 76A and 76B, and the third slits 72A and 72B, respectively. In FIG. 3, a center plane of the disk portion 24 of the impeller 22 is designated by a line b, which is extended vertically when the axis of the drive shaft 12 conforms to the desired position a. Furthermore, the length of the drive shaft between a point X at which the bearing 20 is located and a point Y at which the disk 24 is located is designated by L, and a radius of the impeller between the position Y and a location $P_1$ at which the disk portion 24 is connected to the support portion 26 is designated by R. The inclination of the axis of the drive shaft 12, as shown by a solid line a', for an angle of $\theta$ from the desired position a causes the plane of the disk 24 to be also inclined by the same angle $\theta$, as shown by a dotted line b'. This inclination causes the point $P_1$ of impeller to be moved to a location $P_1'$, as shown in the figure. In this case, the change in the thickness $C_1$ of the slits 74A and 74B is designated by $\Delta C_1$, which is substantially equal to $L \times \tan\theta$, and the change in the thickness $C_2$ of the slits 76A and 76B is designated by $\Delta C_2$, which is also substantially equal to $L \times \tan\theta$. In this case, the ratio of the change in the thickness of the second slit 76A or 76B with respect to the thickness of the first slit 74A or 74B, $\Delta C_2/\Delta C_1$, is substantially equal to R/L. Note, according to the usual pump design, it is relatively easy to ensure that the value of the axial length L is less than a half of the value of the radius R of the impeller 24.

Figure 4:
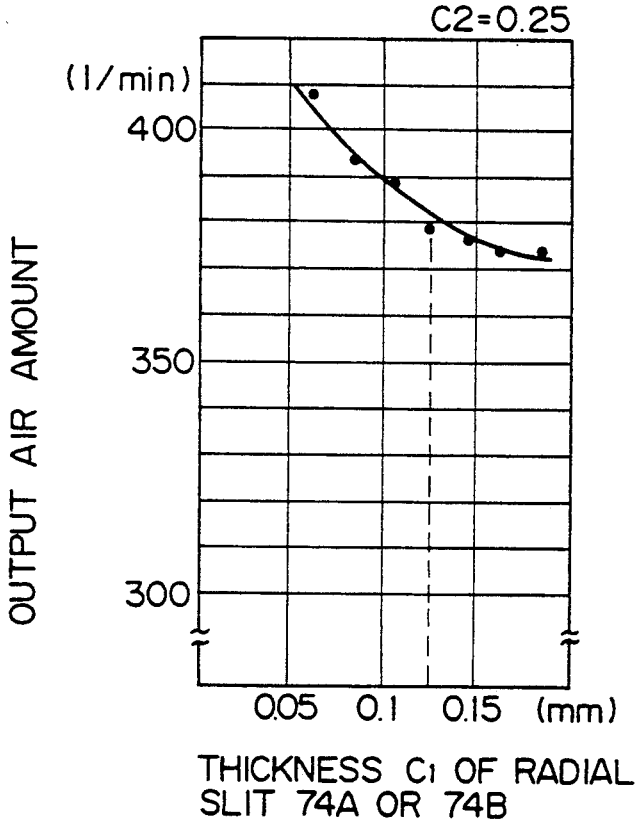
FIG. 4 shows the relationship between the thickness of the radial slit and the amount of air output from the pump.

FIG. 4 shows a relationship between a value of the thickness $C_1$ of the radial slit 74A or 74B, in millimeters, and the amount of fluid discharged from pump. Note, the value of the thickness of the outer axial slit 76A or 76B, side clearance is made 0.25 mm, to thereby prevent any contact therebetween as long as the plane of the disk 24 is inclined with respect to the axis of the shaft 21 for an angle $\theta$ having a value in a usually generated range. As clear from FIG. 4, a noticeable increase in the flow amount discharged is obtained by a value of the clearance $C_1$ smaller than 0.125 mm, i.e, a half of the value of the side clearance $C_2$. Note, a setting of the value of the thickness of the intermediate slit 81, $C_1$ smaller than the value of $\Delta C_1$, obtained from the equation, $$\Delta C_1 = \Delta C_2 \times (L/R)$$

causes a contact to be first generated in the radial slit 74A or 74B upon the inclination of the plane b of the impeller with respect to the axis a of the shaft 12. Preferably a contact in the radial slit 74A or 74B and a contact in the axial slit 76A or 76B $C_1$ occur simultaneously upon the inclination of the plane b of the impeller with respect to the axis a of the shaft 12, which is substantially affirmed when a relationship is maintained such that $C_2/C_1$ is equal to R/L. Note, according to the usual pump design, it is relatively easy to ensure that $C_2/C_1$ is equal to R/L.

Figure 5:
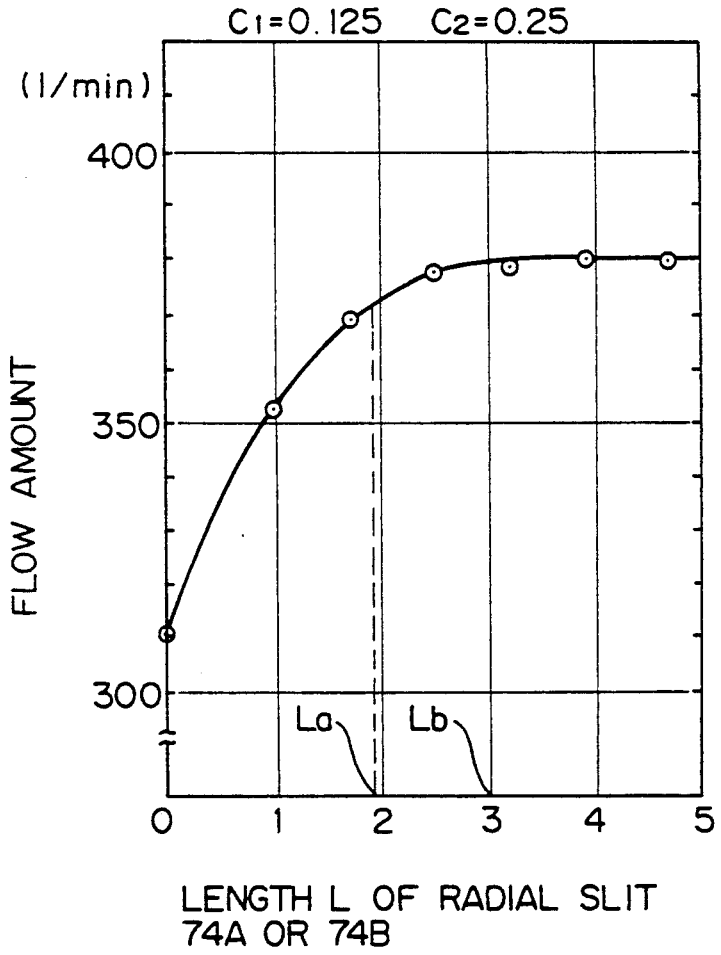
FIG. 5 shows the relationship between the length of the radial slit and the amount of air flow from the pump.

FIG. 5 shows a relationship between the length L of the radial slit 74A or 74B and the amount of the fluid discharged, which corresponds to the sealing efficiency of the slit 74A or 74B. In this case, the value of $C_2$ (thickness of the radial slit 74A or 74B) was 0.25 mm, and the value of $C_1$ (thickness of the axial slit 76A or 76B) was 0.125 mm. As will be seen from FIG. 5, a value of the length L of the radial slit 74A or 74B larger than Lb (=3 mm) causes an increase in the discharged fluid amount to saturating point, and causes the thickness of the disk portion 24 to be decreased. The small thickness of the disk portion 24 is disadvantageous when the rotational speed of the pump is high. Contrary to this, a value of the length L of the radial slit 74A or 74B smaller than La (=2 mm) can cause only a small increase in the discharged fluid amount. According to a usual design of a vortex pump for a motor vehicle, the value of $C_1$ is about 0.125 mm, and thus the selection of the value of L between the above range of La to Lb can obtain a desired effect.

The material selection is now discussed. The housing 14 and cover 34 are both made from aluminum alloy, and the impeller 22 is a resin and fiber glass composition material made of PPS (Polyphenylene Sulfide) resin and 40% glass fiber. The glass fibers in the impeller are arranged so that they are oriented radially, to thereby obtain a designated fiber reinforcing effect.

An injection moulding process is employed to obtain the designated shape of the impeller 22, i.e., the plastic resin material is injected into a mould. In this case, a center gate process is employed whereby the resin material is introduced radially outwardly into the mould from the center portion thereof, which is advantageous in that cracks in the obtained weld are prevented, i.e., prevent the generation of a weld line. After injection moulding, the obtained products are machined, particularly the surfaces 24A and 24B, 26A and 26B, and 26-1A and 26-1B which face corresponding surfaces 36-1 and 38-1, 36-2 and 38-2, and 14-2 and 34-2 after assembly, whereby the desired values of the thickness of the slits 72A and 72B, 74A and 74B, and 76A and 76B are obtained.

Figure 6:
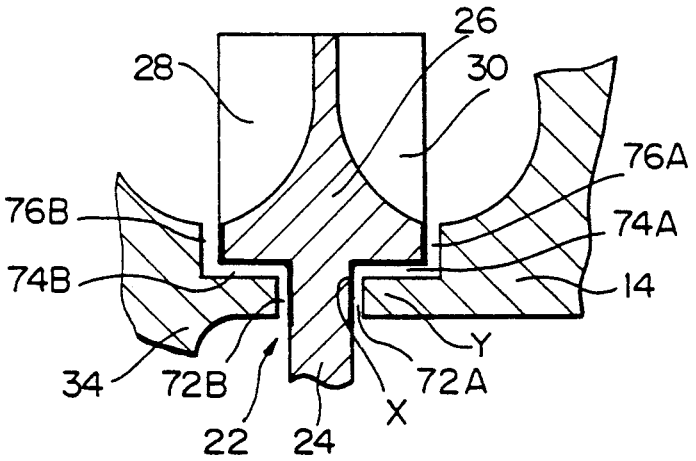
FIG. 6 is a partial view of FIG. 1, for illustrating a surface-machined condition at a location at which the seal portion is created; and, FIG. 7 is a partial view of a second embodiment of the present invention.

The impeller 20 just after the injection moulding process is machined only at positions X (shown by thickened lines) around the projections 36 and 38 in FIG. 6 facing the housing 14 and cover 34, for constructing the slits 72A and 72B, 74A and 74B, and 76A and 76B. Namely, the housing 14 and the cover 34 face only limited portions Y of the impeller 20, which is advantageous in that an amount of area for which a precise machining is required is reduced.

The direction of the orientation of the glass fibers in the impeller 20 along the radial direction causes the linear thermal expansion coefficient measured at the region near the radial slit 74A or 74B to be a value of $2.2\times10^{-5}$/°C., which is smaller than the linear thermal expansion coefficient measured at the region near the inner axial slits 72A or 72B, or 76A or 76B having a value of $3.4\times10^{-5}$/°C., wherein the value of the radius of the disk 24, $R_1$ was 81.5 mm, and the thickness thereof was 13.5 mm. It should be noted that the value of the linear thermal expansion coefficient of the aluminum alloy for obtaining the housing 14 and the cover 34 is $2.1\times10^{-5}$/°C., which is substantially equal to the linear thermal expansion coefficient of the support member 26 at the outer axial slit 74A or 74B, and thus prevents a varying of the thickness of the slit $C_1$ due to changes in temperature.

In the above embodiment, the impeller 20 is made of a composite material of resin and glass fibers oriented to obtain a decreased weight while increasing the rotational speed, and a high strength aluminum alloy is employed for the housing 14 and the cover 34, to make it easy to obtain a desired shape at a low cost. Furthermore, the thermal expansion factor in the radial direction Z at the portion of the impeller 20 adjacent to the radial slits 74A and 74B is maintained in a range substantially equal to the thermal expansion factor Y of the housing 14 and the cover 34, so that a equation $$Z=a\times Y.$$

is obtained, wherein a is in a range between 0.9 to 1.1. As a result, a desired sealing operation along the radial slits 74A and 74B created by radially-spaced axially-extending annular surfaces 36-2 and 26-A, and 38-2 and 26B, is obtained regardless of changes in temperature, while preventing any contact therebetween.

In the above embodiment, the fluid to be discharged is air, but another fluid, such as water, also can be used. Furthermore, in place of the electric motor integrated type pump, a belt drive mechanism can be employed for operating the pump.

Figure 7:
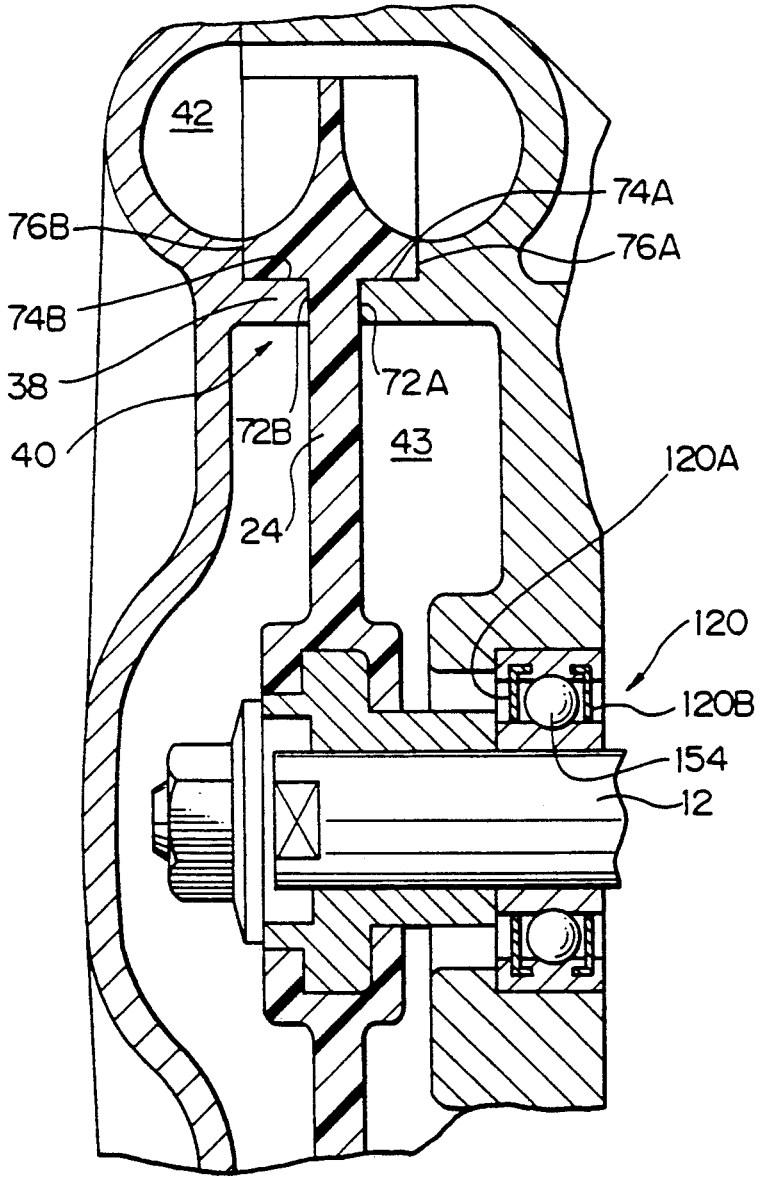

In the embodiment shown in FIG. 7, the bearing for supporting the drive shaft 12 is constructed by a seal bearing 120 having a pair of seal rings 120A and 120B between which balls 154 are sealingly arranged together with grease. This construction allows the disk chamber 43 to be sealed, so that the pressure in the disk chamber 43 to which the air from the vortex chamber 43 is leaked is under a pressure between the pressure in the vortex chamber 42 and the intake pressure into the vortex chamber 42, i.e., the atmospheric pressure. As a result, the pressure in the disk chamber 43 is larger than the atmospheric pressure, and accordingly, the pressure difference between the vortex chamber 42 and the disk chamber 43 is decreased, which can increase the sealing effect by the seal portion constructed by the axial slits 72A and 72B, the radial slits 74A and 74B, and the axial slits 76A and 76B.

Although the present invention is described with reference to the attached drawings, many modification and changes can be made by those skilled in this art without departing from the scope and spirit of the present invention.

We claim:

1. A vortex pump comprising:

a casing;

a drive shaft having axially spaced-apart ends, the shaft being rotatable with respect to the casing;

a pair of axially spaced-apart bearing units for supporting the shaft with respect to the casing;

said casing defining therein an annular vortex chamber about an axis of the drive shaft and an annular gap inward of the vortex chamber with respect to the drive shaft;

inlet duct means for introducing a fluid into the vortex chamber;

outlet duct means for removing the fluid from the vortex chamber;

an impeller having a disk portion having axially spaced-apart major surfaces extending transversely to the axis of the shaft, an annular support portion at an outer peripheral end of the disk portion and having an axis width larger than that of the disk portion, and rows of a plurality of circumferentially spaced-apart blades mounted on the annular support portion, and;

means for connecting the disk portion to the drive shaft so that the impeller is rotated integrally with the drive shaft;

the blade portions being arranged so as to act on the fluid in the vortex chamber in such a manner that a forced flow of the air from the inlet duct means to the outlet duct means is generated, and;

the disk portion passes radially through the annular gap so that a seal portion is created between the impeller and the casing by an axially spaced-apart pair of annular first slits formed between axially spaced-apart faced surfaces of the disk portion and the casing, extending transversely to the axis of the shaft; an axially spaced-apart pair of annular second slit formed between radially spaced-apart cylindrical surfaces of the casing and the impeller, and located radially outward of the inner slits; and an axially spaced-apart pair of annular third slits formed between axially spaced-apart facing surfaces of the casing and the impeller, extending transversely to the axis of the shaft and located radially outward of the second slits;

said second slits having a radial thickness smaller than a half of a thickness of at least one of the first and second slits, the length of the second slits being between 2 mm and 5 mm.

2. A vortex pump according to claim 1, wherein said casing comprises a housing and a cover separate from the housing, and means for connecting said cover to the housing, the drive shaft being connected to the housing by said axially spaced-apart bearing means, and;

wherein said housing and casing are provided with axially extending annular projections, respectively, which face each other so that said annular gap is formed between the facing annular projections.

3. A vortex pump according to claim 2, wherein the impeller is made by an injection moulding of a plastic material, and only portions of the moulded impeller facing the projections, for creating the first, second and third slits, are machined.

4. A vortex pump according to claim 1, wherein said casing is made from aluminum alloy and the impeller is made of composite material from resin material and glass fibers, the grass fibers being oriented radially of the disk portion so that a thermal expansion of the impeller and a thermal expansion of the casing are substantially equal at a location adjacent to the second slits.

5. A vortex pump according to claim 1, wherein one of said bearing members adjacent to the impeller is constructed by a seal bearing.

* * * * *